United States Patent [19]

Fabian et al.

[11] 4,364,811

[45] Dec. 21, 1982

[54] ELECTRODES FOR ELECTROLYTIC CELLS

[75] Inventors: Peter Fabian; Karlheinz Eisenhuth, both of Freigericht; Ernst Jedlitschka, Bruchköbel; Helmut Krebs, Freigericht, all of Fed. Rep. of Germany

[73] Assignee: Heraeus Elektroden GmbH, Hanau am Main, Fed. Rep. of Germany

[21] Appl. No.: 212,570

[22] Filed: Dec. 3, 1980

[30] Foreign Application Priority Data

Dec. 8, 1979 [DE] Fed. Rep. of Germany ..... 2949495

[51] Int. Cl.[3] ..... C25B 9/04; C25B 11/02

[52] U.S. Cl. ..... 204/220; 204/288; 204/289; 204/290 F

[58] Field of Search ..... 204/280, 286–289, 204/219–220, 250, 99, 290 F, 225

[56] References Cited

U.S. PATENT DOCUMENTS

| | | | |
|---|---|---|---|
| 3,725,223 | 4/1973 | DeNora et al. | 204/219 X |
| 4,022,679 | 5/1977 | Koziol et al. | 204/266 |
| 4,149,956 | 4/1979 | Bess, Sr. et al. | 204/289 X |

FOREIGN PATENT DOCUMENTS

| | | | |
|---|---|---|---|
| 483129 | 11/1975 | U.S.S.R. | 204/286 |

*Primary Examiner*—Donald R. Valentine

*Attorney, Agent, or Firm*—Hammond & Littell, Weissenberger and Muserlian

[57] ABSTRACT

This invention relates to electrodes for electrolytic cells. More particularly, this invention relates to electrodes for an electrolytic cell comprising:

(a) means for supplying electric current;

(b) a main current distributor;

(c) rectangular-sectioned conductors having flat activated electrode faces and arranged standing upright, the ratio of the width to height of a cross-section being from about 1:5 to about 2:3; and (d) flat, rectangular-sectioned current distributors arranged perpendicularly to the conductors (c) and spaced from about 30 to about 150 mm apart, the ratio of the width to height of a cross-section being smaller than that for the cross-section of conductors (c), the ratio of free passage area to projected area in the zone of the conductors (c) being from about 20:30 to about 60:80 and conductors (c) being connected to current distributors (d), which are in turn connected to main current distributor (b).

17 Claims, 3 Drawing Figures

ELECTRODES FOR ELECTROLYTIC CELLS

FIELD OF THE INVENTION

This invention relates to electrodes for electrolytic cells. More particularly, this invention relates to electrodes comprised of (i) a main current distributor and (ii) two planes of flat section conductors sequentially and perpendicularly affixed thereto.

BACKGROUND OF THE INVENTION

In known metal anodes, especially dimensionally stable anodes, an active coat is applied to a row of horizontal circular titanium rods arranged parallel to one another, which rods are held together by means of uncoated transverse ribs. However, electrodes with round grid rods are unsatisfactory for several reasons, especially because of the disadvantageous current distribution resulting from "current shadow formation" with respect to the counter-electrode, at least in mercury electrolysis cells, and a remedy has been sought.

Metal anodes are also known in which electrical conductors distribute current over several planes in the electrode (compare, German Published Application (DE-AS) No. 1,818,035). Since, however, the conductor plane facing the counter-electrode consists of activated screen material, this has, as in the case of round rods, the disadvantage that relatively large active surfaces lie in the current shadow and the actual surface to be reached is relatively small with respect to the projected surface.

It has also been proposed to arrange the anode grid structure in the form of flat strips or bands or U-shaped channels or inverted U-channels, the latter of which is the subject of British Pat. No. 1,394,026. The individual channel-shaped parts are welded together at the connecting arcs of the inverted U-sections. The British patent provides for an adequate gap between the bands of each channel-shaped element to allow the access of a spot-welding tool-head when the channel-shaped elements are to be connected to a conductor by spot-welding. On the other hand, this limits the number of individual conductor elements, which should be high with regard to the current distribution. In addition, the arcs between the connecting cross-pieces at the top of the inverted U-elements must be removed, which results in relatively significant waste of titanium. Also, the problem of mass transfer, especially in mercury cells, is not solved.

It is the object of the disclosure of German Published Application (DE-AS) No. 2,323,497, to promote mass transfer, particularly for improved gas escape from the bottom of anodes in cells which operate with current densities greater than 10 kA/m$^2$. The promotion of mass transfer is achieved by use of an exceedingly large active surface in the zones near, as well as far from, the counter-electrode. One drawback, however, is that the current transport occurs practically only over one conductor plane with a single transversely extending rod, which leads to a strongly variable current distribution at the active electrode surface.

A more significant drawback is that the main current distributor lies directly above the activated surface, so that the gas escape conditions and the flow conditions are not uniform at the active surfaces and are thus negatively influenced. The great height of the vertically arranged coated titanium bands result in their operating only slightly in the remote zone due to the relatively high electrolyte resistance, except at the cost of a higher voltage with a corresponding higher consumption of electrical energy, hence higher operating costs. As the bands are only inter-connected at the top by a few transverse welding seams, the bands of this electrode structure can very easily be brought apart at their outer ends, transversely to their longitudinal direction. The bands of this structure can moreover only be welded with great effort to the transverse beams.

German Published Application No. 2,323,497 does not address the problem of nevertheless ensuring adequate mechanical stability or form stability when using thin bands, especially with regard to bending and twisting stiffness. These requirements must be met, as must be the requirements of uniform current distribution, good gas kinetics, low fabrication and low repair costs, long life of the structure and coating, and good resistance to short-circuiting. The weight of the electrodes is likewise important, not only because of the manufacturing and transportation costs but also because of the expensive cost of the materials used.

OBJECTS OF THE INVENTION

It is an object of the invention to provide a novel electrode for an electrolytic cell.

It is also an object of the invention to provide an electrode for an electrolytic cell which complies with the requirements of mechanical stability, form stability, uniform current distribution, good gas kinetics, low fabrication and low repair costs, long life of the structure and coating, and good resistance to short-circuiting.

It is a further object of the invention to provide an electrode comprising:

(a) means for supplying electric current;

(b) a main current distributor;

(c) rectangular-sectioned conductors having flat activated electrode faces and arranged standing upright, the width to height ratio of a cross-section being from about 1:5 to about 2:3; and (d) flat, rectangular-sectioned current distributors arranged perpendicularly to the conductors (c) and spaced from about 30 to 150 mm apart and having a width to height ratio less than that for the conductors (c), the ratio of free passage area to projected area in the zone of the flat sections of the conductors (c) being from about 20:30 to about 60:80 and conductors (c) being connected to current distributors (d), which are in turn connected to main current distributor (b).

These and other objects of the invention will become more apparent in the discussion below.

DETAILED DESCRIPTION OF THE INVENTION

Figure 1:
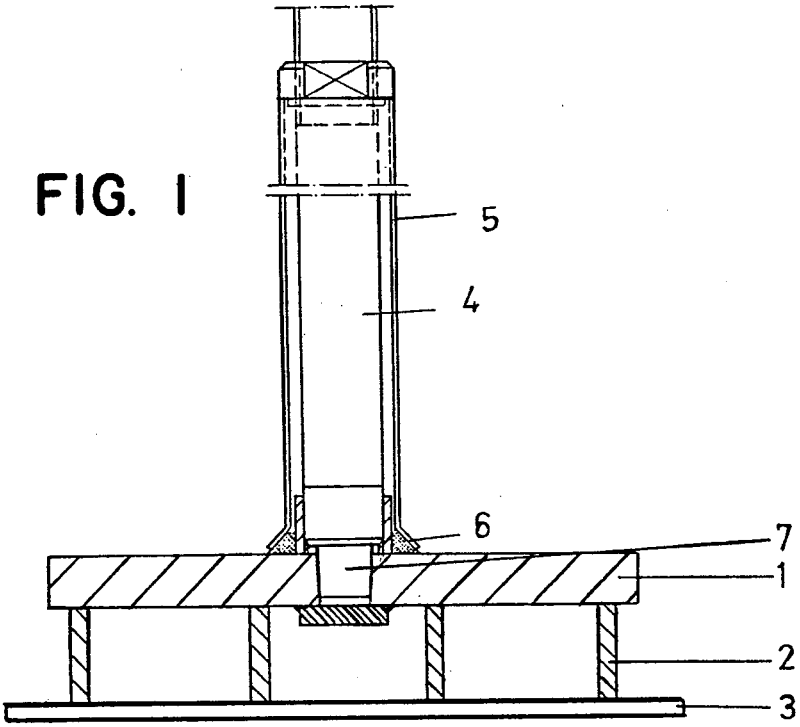
FIG. 1 represents a cross-sectional view along the median axis of the electrode of the invention.

The invention herein is intended to fulfill the requirements above as well as possible, given that some of the requirements conflict, and better than electrodes previously known. The electrode according to the invention comprises an electrode for electrolytic cells, especially for chloralkali mercury electrolytic cells, with current supplied by a rod or pin connected with activated electrode parts of flat sections having rectangular cross-sections via a main current distributor in the form of a flat section having rectangular cross-section and extending transversely thereto for distributing the current. The electrode comprises:

(a) means for supplyingg electric current;

(b) a main current distributor;

(c) activated electrode parts comprising conductors consisting of flat, rectangular-sectioned sections which have flat faces and are arranged standing upright, the ratio of width to height of a cross-section being from about 1:5 to about 2:3; and (d) flat, rectangular-sectioned current distributors arranged perpendicularly to the conductors (c) and spaced from about 30 to about 150 mm apart, the ratio of the width to height of a cross-section being smaller than that for the cross-section of conductors (c), the ratio of free passage area to projected area in the zone of the flat sections of the conductors (c) being from about 20:30 to about 60:80 and conductors (c) being connected to current distributors (d), which are in turn connected to main current distributor (b).

The respective conductors, i.e., main current distributor (b), current distributors (d), and conductors (c) are preferably arranged in three planes above each other, perpendicularly to each other in adjacent planes, and consist of flat sections having rectangular profiles, or cross-sections. In the embodiment of the invention, the flat sections of one plane, the third plane, face the counter-electrode, the overlying flat sections of the second plane are positioned upright and are perpendicular to the flat sections of the third plane, and the flat section of the first plane is likewise perpendicular to the flat sections of the second plane. In addition, the flat section of the first plane, i.e., the main current distributor, lies flat on the current distributors of the second plane. The main current distributor is connected with the current terminal (rod or pin) or its protective tube.

The essential advantages of the invention are the following:

(1) favorable current distribution over the three conductor planes with optimally dimensioned flat sections having rectangular profiles;

(2) high stability of the electrode as well as mechanical stability (rigidity to twist), especially because of the more favorable moment of resistance of rectangular sections by comparison with round sections and square sections, also because all flat sections of the individual planes are in each case disposed perpendicularly to one another;

(3) high safety of transportation, because the rigidity of the electrode structure is hard to surmount even by external influences;

(4) good planarity of the flat-bottom side of the electrode remaining not only after fabrication and transportation, but also after mounting (assembly and disassembly) as well as during operation, which leads to a reduction of the operation costs because a more favorable, uniform spacing is maintained with respect to the counter-electrode;

(5) safety against thermal distortion during reactivation (this corresponds to the twist-resistant structure of the electrode according to the invention);

(6) good mass transfer kinetics, due not only to the vertically disposed flat sections coated all around but also to their favorable spacing and number of conductors per area;

(7) good weldability due to the mutual association of the conductor planes;

(8) reduction of short-circuiting risks, because planarity is maintained even after transportation and mounting, as well as in operation; and (9) a very great economy of materials as compared to an electrode of equal surface area of high-grade materials such as titanium, in the embodiment given by way of example up to 75%, hence correspondingly higher economy.

A further economic advantage is the simple form of the material of the conductors (flat section or rectangular section), which permits the use of standard prefabricated material at optimum purchase cost and with favorable storage. There is a good degree of utilization of energy of the electrode according to the invention, which is also economical, especially in chlor-alkali mercury electrolytic installations, due to uniform current distribution.

The good parallelity of the individual conductors of the three planes is a consequence of high rigidity to twisting of the electrode structure according to the invention as well as its assembly. The average spacing between anode and cathode in the electrolytic cells is maintained optimally small, un-influenced by slight deviations of planarity.

In operation, the electrode of the invention is used as an anode in the electrolytic cell, preferably while the counter-electrode is a mercury cathode formed of mercury flowing in the direction in which the conductors extend, with a spacing between the anode and the cathode of a few millimeters, preferably 3 mm. The anode is substantially flat on the bottom side thereof (flat or rectangular section bottom side of the conductors of the third plane) and is mounted in the electrolytic cell in such a manner that the spacing is adjustable.

According to a preferred embodiment of the invention, the flat section conductors in the second and third planes are connected together by projection welding. The main current distributor may also be welded to the flat section conductors of the second plane.

Further advantages of the invention can be seen from the embodiments of the invention reflected in the drawings. The electrode shown in FIGS. 1 to 3 comprises three planes of conductors, the conductors being flat, rectangular-cross-sectioned sections. The conductr of the first plane, i.e., the main current distributor 1, is arranged above the current distributors of the second plane 2, which are in turn arranged above the conductors of the third plane 3. The conductors 3 are arranged facing the counter-electrode when mounted in an electrolytic cell, preferably a chlor-alkali mercury electrolytic cell with mercury flowing in a direction parallel to the conductors 3, which are then situated anodically with respect to the mercury, which forms the cathode.

The gap between the bottom side of the electrode and the counter-electrode is advantageously about 3 mm. It can, however, be adjusted to be different because the current supply pin 4 of the electrode is so mounted or suspended above the cell that it permits a uniform parallel adjustment of the gap. The electrode gap should be, on the one hand, as small as possible, if the current consumption is to be reduced, and, on the other hand, not too small, since the risk of short-circuiting is thereby increased and side-reactions may occur which reduce the current efficiency.

The current connector of the supply pin 4 is not shown since it is of a type known per se. The pin can be made, for example, of a suitable electrical conductor such as copper, and it is contained in a titanium cover-tube 5, which in turn is connected at the bottom end at 6 to the flat section conductor of the first plane, main current distributor.

Figure 2:
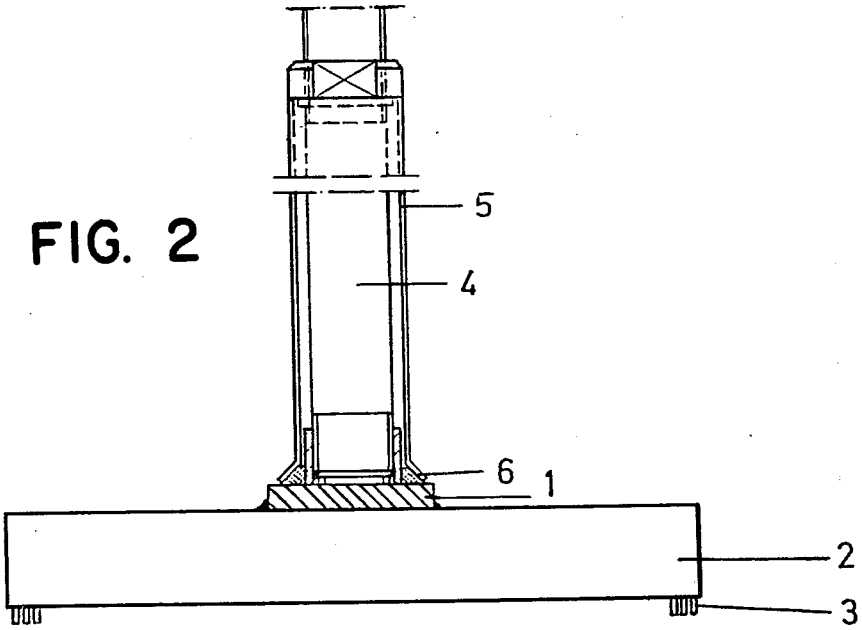
FIG. 2 represents a partial cross-sectional view perpendicular to the median axis of the electrode shown in FIG. 1.

The pin or rod 4 may advantageously comprise at the bottom end a contact surface which is as large as possible, such as the conical surface shown by way of example in FIG. 1, and this contact 7 may be connected to main current distributor 1 either in a fixed or releasable manner by means of welding, pressure fitting, screwing, riveting, or the like. A removable connection is preferred since the portion of the electrode comprised of elements 1, 2, and 3 may be separately placed and treated elsewhere, for example, for reactivation.

The conductors of the third plane 3 are advantageously flat sections with rectangular cross-sections and are made of a metal selected from the group consisting of titanium, niobium, tantalum, other electrically conductive metals, and their alloys, which are in each case resistant to the electrolysis process. Main current distributor 1 and current distributors 2 can be comprised of metals selected from the same group.

The conductors 3 are from about 1 to 2 mm in thickness, preferably about 1.5 mm, and have a height of from about 3 to 5 mm, preferably from about 4 to 5 mm.

The spacing between the parallel conductors 3 is from about 2 to about 6 mm, although a spacing closer to 2 mm, i.e., from about 2 to 3 mm, is preferred. The gap is so selected that the gas escape vanes which occur at the active surfaces of the conductors 3 do not come into contact with each other in the zone of the gap and thereby cause turbulence, but remain separate so that the ions which are discharged at the electrode surface can get to the active surfaces as fast as possible without impediment from gas bubbles. When the gap is selected, the specific electric loading per unit area should also be considered. A further consideration is that, on the one hand, for energy reasons, a high number of flat-section conductors 3 per unit area is desirable because of the then greater active area but, on the other hand, the mass transfer and the gas kinetics must be sufficiently high, which is only ensured when the area of passage is adequate.

In the electrode according to the invention, the conductors of the third plane 3 are either made consisting entirely or partly of catalytically active material or are provided entirely or partially with a catalytically active coating. A catalytically active coating on the entire outer surface of conductors 3 is preferred, hence also on the bottom sides, which face the counter electrode. The coating materials and methods are known per se. Conductors 3 as well as the current distributors 1 and 2 are preferably selected for a specific electrical loading of the electrode of from about 2.5 to about 10 $kA/m^2$, more preferably about 10 $kA/m^2$. The ratio of free passage area to projected area in the zone of the conductors of the third plane 3 is from about 20:30 to about 60:80.

The current distributors of the second plane 2 are welded with spacing of from about 30 to about 150 mm apart, to the main current distributor 1. They consist of sheet material with from about 3 to about 7 mm thickness and a height of from about 20 to about 50 mm. The choice of the dimensions of the rectangular cross-sections of the conductors 2 and 3 will essentially depend on the desired current density. The conductors of the individual planes may then be selected with varying dimensions, but should always present a rectangular cross-section in accordance with the invention, to be able to use commercial sheet material as far as possible. Such a selection of varying dimensions of the individual conductors of the various planes in fact provides an essential advantage of the invention (adaptation of the application in each case).

Figure 3:
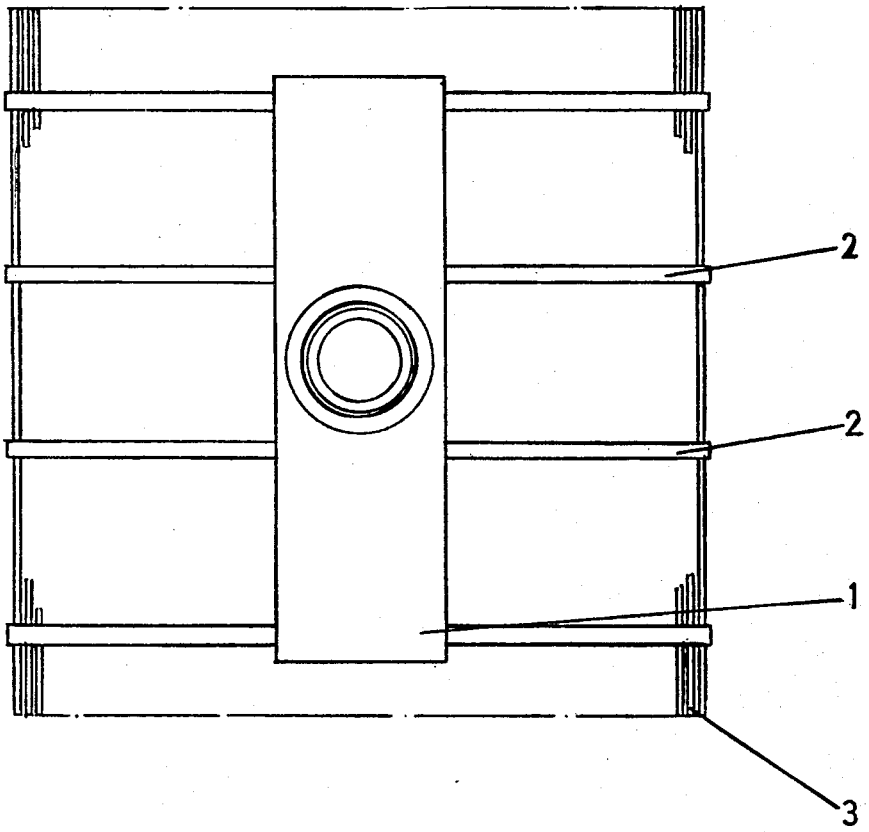
FIG. 3 represents a planar view of the electrode with a square base area.

The good current distribution of the electrode according to the invention is due primarily to the fact, which may be seen particularly from FIG. 3, that it is arranged completely symetrically or in mirror image with respect to the median axis and provides therefore a uniform distribution in the number of the conductors of each plane.

The conductor or main current distributor 1 preferably consists of a flat section with a rectangular cross-section which is arranged lying flat, connected at its upper side at 6 with the tube 5 of the current supply pin or rod 4 and at its bottom side with the conductors 2 of the second plane, these being arranged upright, hence vertically, perpendicular to the flat section conductor 1 (compare, FIG. 3). The conductors of the third plane 3 are connected with the conductors of the second plane 2, preferably by projection welding, in such a manner that the conductors 3 are also arranged upright, i.e., vertically, perpendicular to conductors 2 (see, FIG. 3). By selection of projection welding as a special resistance welding method without welding additives one can obtain the advantage of a rapid and automatic weldability (by means of beam electrode), whereby many conductors in one plane may be welded at one time to those of the next plane. A further advantage of the projection welding is heat generation during welding is only slight and thus less overall deformation of the electrode parts occurs during fabrication. Electrodes according to the invention could be manufactured according to this method with a plane parallelity (at the bottom side of the conductors 3) of 0.25 mm. Also, the possibility of repair or reactivation is considerably improved with electrodes welded in this manner. Improvement of the planarity leads in practical operation of an electrolytic cell to uniform local current distribution on the surface of the electrode facing the counter-electrode to a better current efficiency during operation of the cell, and also to a longer coating service life (increase to lifetime).

As may be seen especially from FIG. 3, a rectangular base area of the electrode, that is, area of the conductors 3, is preferred. This is not, however, imperative. Also, the number of the conductors 3 per area may be varied, as long as the limits given by the claims with regard to the ratio of free area to projected area in the range of the conductors of the third plane is maintained.

In an electrolysis installation, several electrodes may of course be connected electrically or mechanically via busbars in any desired manner for common operation.

The conductor of the first plane, main current distributor 1, preferably comprises a single flat section having a rectangular cross-section, the width of which is from about 30 to about 80 mm and the height of which is from about 10 to about 25 mm. However, the main current distributor 1 may also comprise two or more flat sections or conductors arranged in a symmetrical fashion.

Preferably, the flat section conductors of the first plane 1 are less in number than those of the second plane 2 and those of the second plane 2 are less in number than those of the third plane of conductors 3 facing the counter-electrode. In addition, the first conductor plane preferably has a rectangular section of greater width than height which extends parallel to the conductors of the bottom plane which face the counter-electrode. It should be noted that the main current distributor 1 could in fact be a circular disc section or even a rod having a flat end in contact with conductors 2. In addition, it could also be arranged in the shape of a flat section cross, with the rod or bolt 4 as the point of intersection.

The number, shape and arrangement of the conductors of the second plane, current distributors of flat section, may be adapted to the application in each case, as long as the conditions mentioned herein are met.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. An electrode for electrolytic cell comprising:
(a) a means for supplying electric current;
(b) a main current distributor;
(c) rectangular-sectioned conductors having flat activated electrode faces and arranged standing upright, the ratio of the width to height of a cross-section being from about 1:5 to about 2:3; and
(d) flat, rectangular-sectioned current distributors arranged perpendicularly to the conductors (c) and spaced from about 30 to about 150 mm apart, the ratio of the width to height of a cross-section being smaller than that for the cross-section of conductors (c), the ratio of free passage area to projected area in the zone of the conductors (c) being from about 20:30 to about 60:80 and conductors (c) being connected to current distributors (d), which are in turn connected to main current distributor (b) and the components (b), (c), and (d) being arranged in three planes above each other, perpendicular to each other in adjacent planes, and all consisting of flat sections having rectangular cross-sections.

2. The electrode of claim 1, wherein conductors (c), which face a counter-electrode, and overlying current distributor (d) are arranged upright as current distributors and are welded to be perpendicular to each other, the main current distributor (b) is welded perpendicularly to the current distributors (d) in such a manner as to lay flat upon the current distributors (d), and the main current distributor (b) is connected with the current supply means by means of a current terminal comprising a rod or pin or a protective tube or cover thereto.

3. The electrode of claim 1, wherein the main current distributor (b) comprises one or more conducting elements, the number of conducting elements being less than the number of current distributors (d) which in turn is less than the number of conductors (c).

4. The electrode of claim 1, wherein the main current distributor (b) comprises a rod or beam having a rectangular section of greater width than height, the main curent distributor extending parallel to the conductors (c).

5. The electrode of claim 1, wherein the cross-section of current distributors (d) has a width of from about 3 to about 7 mm and a height of from about 20 to about 50 mm.

6. The electrode of claim 1, wherein the cross-section of conductors (c) has a width of from about 1 to about 2 mm and a height of from about 3 to about 5 mm.

7. The electrode of claim 1, wherein gaps of from about 2 to about 6 mm are provided between parallel conductors (c).

8. The electrode of claim 7, wherein the gaps are from about 2 to about 3 mm.

9. An electrode of claim 1, wherein the components (b), (c), and (d) are capable of having a current density of from about 2.5 to about 15 $kA/m^2$.

10. An electrode of claim 9, wherein the components (b), (c), and (d) are capable of having a current density of up to about 10 $kA/m^2$.

11. An electrode of claim 1, wherein the components (b), (c), and (d) are each comprised of a metal selected from the group consisting of titanium, niobium, tantalum, other electrically conducting metals, and alloys thereof, which are stable during operation of the electrolytic cell.

12. An electrode of claim 1, wherein the conductors (c) consist entirely or partly of catalytically active material or have their surface partly or entirely coated therewith.

13. An electrode of claim 12 in which the surface of conductors (c) is entirely coated with catalytically active material.

14. An electrode of claim 1, wherein the electrode is used as an anode in a chlor-alkali mercury cell, the cell has a cathode comprised of mercury flowing in the direction of conductors (c), the anode and cathode are spaced a few millimeters apart, the electrode is substantially flat with regard to the conductors (c), and the electrode is mounted in the cell in such a manner that the spacing is adjustable.

15. The electrode of claim 14, wherein the anode and cathode are spaced from about 1 to about 10 mm apart.

16. The electrode of claim 15, wherein the anode and cathode are spaced about 3 mm apart.

17. The electrode of claim 1, wherein the components (b), (c), and (d) are respectively connected together by projection welding.

* * * * *

UNITED STATES PATENT AND TRADEMARK OFFICE

CERTIFICATE OF CORRECTION

PATENT NO. : 4,364,811

DATED : December 21, 1982

INVENTOR(S) : PETER FABIAN ET AL.

It is certified that error appears in the above-identified patent and that said Letters Patent is hereby corrected as shown below:

Title page, [75], before "Fed. Rep. of Germany", please add:

-- Heinrich Simon, Langenselbold, --.

Column 5, line 16: "placed" should read -- replaced --.

Signed and Sealed this

*Third* Day of *May 1983*

[SEAL]

*Attest:*

GERALD J. MOSSINGHOFF

*Attesting Officer*

*Commissioner of Patents and Trademarks*